United States Patent [19]

Biven

[11] 4,112,957

[45] Sep. 12, 1978

[54] SUN-SHIELD FOR BACKPACKERS

[76] Inventor: Earl U. Biven, 6352 Sierra Elena Rd., Irvine, Calif. 92664

[21] Appl. No.: 748,661

[22] Filed: Dec. 8, 1976

Related U.S. Application Data

[63] Continuation of Ser. No. 586,304, Jun. 12, 1975, abandoned.

[51] Int. Cl.[2] ..... A45B 11/02

[52] U.S. Cl. ..... 135/5 C; 135/5.2; 135/7.1 R; 224/5.1; 297/184

[58] Field of Search ..... 135/5 C, 5.1, 7.1 R, 135/5.2; 297/184, 410, 397, 398, 399, 400, 401, 402; 40/125 H, 129 A, 155; 224/5.1, 6, 9, 25 A, 8 R; 5/330

[56] References Cited

U.S. PATENT DOCUMENTS

| | | | |
|---|---|---|---|
| 1,627,847 | 5/1927 | Harold | 224/5.1 |
| 1,909,467 | 5/1933 | Hirose et al. | 135/5.2 |
| 2,534,009 | 12/1950 | Freasier et al. | 297/398 X |
| 3,840,161 | 10/1974 | Boggs et al. | 224/5.1 |

*Primary Examiner*—Price C. Faw, Jr.

*Assistant Examiner*—Conrad L. Berman

*Attorney, Agent, or Firm*—Fischer and Tachner

[57] ABSTRACT

A sun-shield comprising a canopy assembly adaptable for connection to each of a variety of back-pack frames, said frames being supported on a back-packer's back, waist and shoulders. Said assembly having a canopy support frame including vertical support rods, back-pack frame adaptors, right angle members, and a coupling for interconnecting the frame adaptors and right angle members comprising the lower portion of the sun-shield to the canopy assembly comprising the upper portion of the sun-shield. Opaque canopy means, attached to the canopy support frame, prevents the transmission of light through the canopy. Foldable flap members are attached to the canopy means along the edge thereof. The canopy means is positioned to be horizontal, above and displaced from the back-packer's head for blocking out sunlight incident thereon. Said canopy support frame is easily removable from said coupling for separate storing. Attachment means are provided for the attachment of protective coverings to the canopy assembly to shield the back-packer from rain or insects.

2 Claims, 5 Drawing Figures

SUN-SHIELD FOR BACKPACKERS

This is a continuation, of application Ser. No. 586,304, filed June 12, 1975, now abandoned.

SUMMARY OF THE INVENTION

This invention relates to a sun-shield worn by back-packers as an attachment to conventional back-pack frames for the protection of the back-packer from sunlight. This sun-shield is designed to provide such protection without adding any significant weight to the back-packer's burden and to be easily and quickly converted from collapsed to erected condition and vice versa. When fully erected, the sun-shield comprises a relatively large horizontal canopy cantilevered above and separated from the back-packer's head, and a plurality of smaller foldable flap members attched to the horizontal canopy along its perimeter.

The canopy is the primary shield of the sunlight incident upon the back-packer from a generally vertical direction as from a midday sun. The gap between the top of the back-packer's head and the horizontal canopy, permits the free flow of air above and around the back-packer's head thus precluding the accumulation of heated stagnant air such as the air within the cap portion of a hat normally worn by the back-packer to block sunlight.

The flap members are attached to the edge of the canopy and in a first position they may be vertically suspended from the canopy while in a second position they may be folded onto the top or bottom surface of the canopy. The flap members are independently foldable to permit selection of only those flap members which will shield the back-packer's head, face and neck from sunlight incident from the sun in a lower position in the sky as from a morning or afternoon sun.

BACKGROUND OF THE INVENTION

It is generally well known among those who hike the trails of our scenic country that there are several natural enemies of the back-packer. One such enemy is the sun which when unshielded, beats down upon the back-packer's head, face and neck to cause the discomforts of heat and sunburn and also creates the discomforts and danger of sun poisoning and heat prostration. Another such enemy is exhaustion resulting from the long hard trek over a variety of terrain with the necessities of survival being carried along, usually in a back-pack supported on a lightweight metal frame which is in turn supported by the back-packer's back, waist and shoulders.

Prior to the invention of the sun-shield comprising this invention, there had been no known simple, convenient and lightweight means for a back-packer, wearing a conventional back-pack, to protect his head, face and neck from the sunlight. The use of a brimmed hat for that purpose is ineffective because the enclosed cap portion of the hat prevents the free flow of air and results in the accumulation of heated, trapped air above the back-packer's head. The brim of the hat presents the additional disadvantage of the restriction of head motion due to the interference of the back-pack frame with the brim, upon rotation of the back-packer's head.

A principal object of invention is to provide a simple and convenient addition to conventional back-pack equipment which will shield the back-packer from direct sunlight without the usual disadvantages of a brimmed hat and without the addition of significant weight to the back-packer's equipment burden which would result in an increased risk of exhaustion.

It is therefore an additional object of invention to provide a sun-shield which is compatible with conventional back-pack frames.

It is also an object of this invention to provide an easily erectable and collapsible sun-shield canopy so that it is convenient for the back-packer to store the canopy assembly with his other gear when the sun is down, or when he is not using his equipment and so that it is equally convenient for the back-packer to attach the canopy assembly when the sun rises while he is on the trail.

It is yet another object of invention to provide additional inherent conveniences for the back-packer by virtue of his wearing the sun-shield. These additional conveniences include a pack extender as an inherent function of the sun-shield structure; and means for protection of the back-packer from his other natural enemies such as rain and insects, said means for protection comprising various simple attachments to the sun-shield comprising this invention.

It is still an additional object of invention to provide a substantial degree of flexibility of flap configuration for blocking sunlight from any direction relative to the backpacker's direction of travel while concurrently permitting only a minimum obstruction of the back-packer's vision.

Some of the objects of invention having been stated, other objects will appear as the description proceeds when taken in connection with the accompanying drawings.

DETAILED DESCRIPTION

Referring now to the figures, a sun-shield 5 made in accordance with the present invention is shown to be connected to back-pack frame 2 which is normally worn by the back-packer to support and carry back-pack 1. Canopy 6 is positioned to be above and separated from the back-packer's head and incorporates opaque material to block incident sunlight from reaching the back-packer's head, face and neck.

Figure 1:
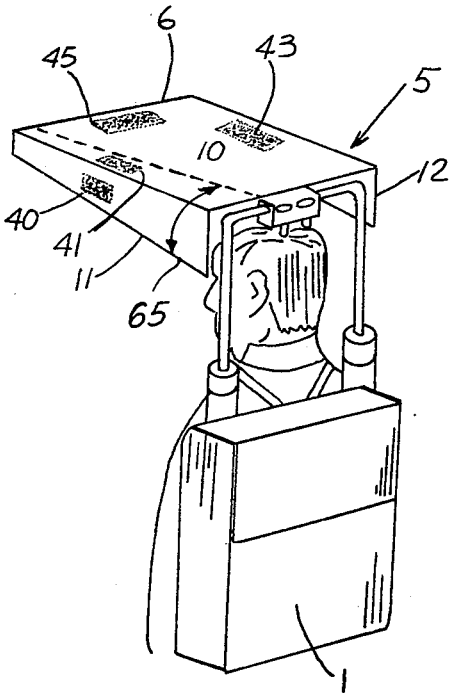
FIG. 1 is a rear isometric view of one embodiment of my invention shown being worn by a back-packer along with a back-pack and a back-pack frame.
Figure 2:
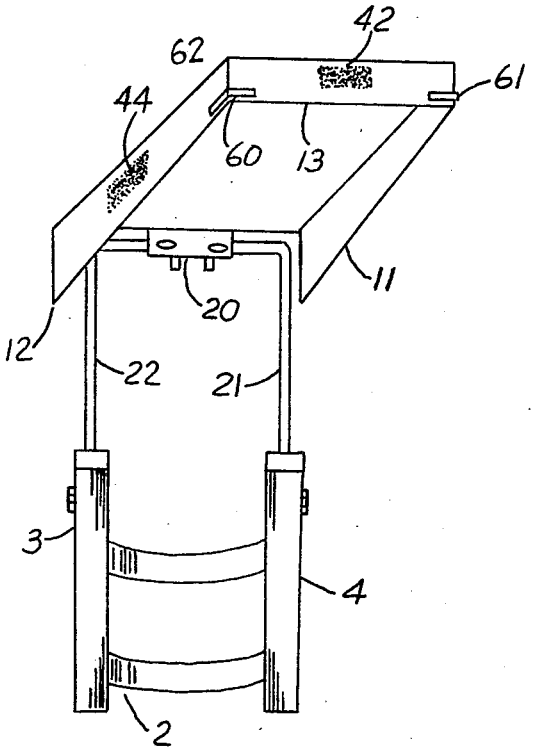
FIG. 2 is a front isometric view of the embodiment shown in FIG. 1, indicating the configuration for adaptation to a typical back-pack frame.

Canopy 6 includes horizontal member 10, front flap member 13 and left and right side flap members 11 and 12 respectively. Though the shape and dimensions of these canopy members may be anything suitable for protection of the backpacker, in one embodiment of this invention the horizontal member 10 is a planar 15 inch by 12 inch rectangle, front flap member 13 is a 12 inch by 2½ inch rectangle and side flap members 11 and 12 are trapezoidal in shape, 15 inches long and varying in width from 2½ inches to 5 inches. FIGS. 1 and 2 show the flap members in the deployed configuration for blocking sunlight incident from a relatively low angle as for example from reflecting surfaces or directly from a morning or afternoon sun. The flap members are secured to one another by tabs 60 and 61 to prevent flapping. Each of the flap members may also be independently folded back onto the horizontal member 10 when its shielding function is not necessary or desirable. Means for adhering the flaps to the horizontal member are desirable to prevent inadvertent unfolding of the flaps during back-packing. Such adhering means may be a simple button snap such as button snap 62 used to detachably secure tab 60 to flap 12; or special adhering material such as Velcro, a commonly used means for such purposes. By way of example, FIGS. 1 and 2 show Velcro strips 40 and 42 and 44 on left side flap 11, front flap 13 and right side flap 12 respectively for adhering those flaps to the top surface of horizontal member 10 at the positions of mating Velcro strips 41, 43 and 45 respectively. As shown in FIG. 1 by the curved arrowhead line and dotted line, edge 65 of flap 11 may be rotated up and on to member 10. Flaps 12 and 13 may also be so rotated.

Figure 4:
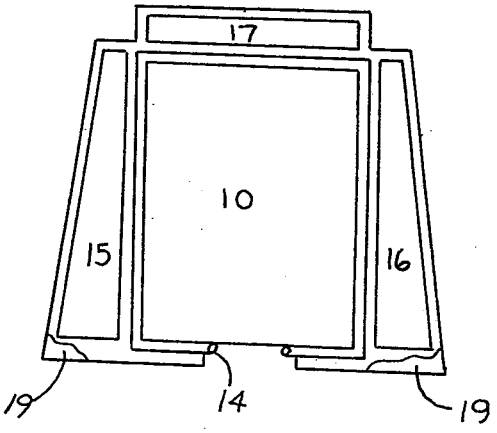
FIG. 4 is a plan view of the canopy of this invention showing top and flap portions, and a covering shown partially cut away.

Canopy 6 is further illustrated in FIG. 4 in which are indicated stiff lightweight body members 15, 16 and 17 which give body to side flaps 11 and 12 and front flap 13 respectively.

Body members 15, 16 and 17 may be made from conventional cardboard or plastic or any suitably stiff and lightweight material. The body members 15, 16 and 17 are interconnected to from canopy 6 by a lightweight cotton cloth covering 19. Of course covering 19 may be made of any suitable lightweight flexible material. The three flap members 11, 12 and 13 may be formed separately by fabricating each such member with the appropriate body member and then covering each such member with an individual covering. All the individual elements can then be sewn together to form the one continuous covering 19. Alternatively, the covering 19 can be pre-cut to the appropriate shape illustrated in FIG. 4, the body members inserted in the covering and then sewn into place.

In either case a suitable spacing is provided along the perimeter of horizontal member 10 for support frame 14 which is also covered by covering 19. Support frame 14 and the remaining structural components of this invention are best understood by referring to FIG. 3.

Support frame 14 provides the structural support for canopy 6 and permits the canopy to be cantilevered out beyond the back-packer's head. Support frame 14 may be a tubular metalic device having a rectangular portion 29 conforming to the shape of the perimeter of horizontal member 10, and two parallel vertical support rods 25 and 26 which extend perpendicular to the plane of the rectangular portion 29.

Figure 3:
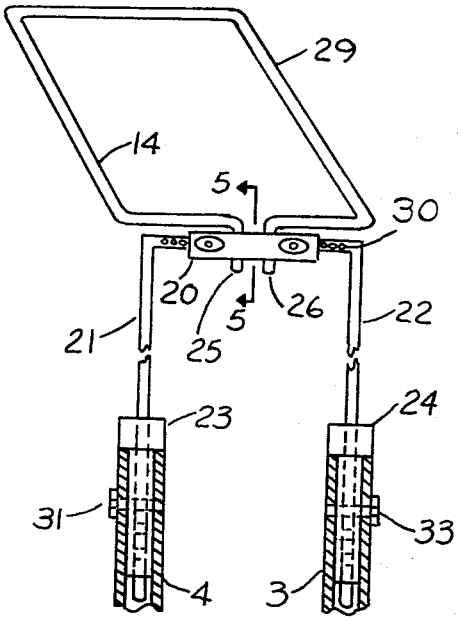
FIG. 3 is a detailed elevational view of my invention illustrating means for supporting the canopy and for adapting the invention to a typical back-pack frame and for attaching it thereto.

Also shown in FIG. 3 are back-pack frame adaptors 23 and 24 which are designed to fit concentrically into the back-pack members 3 and 4 of most back-pack frames available commercially. Right angle members 21 and 22 fit concentrically into appropriate slots provided in adaptors 23 and 24. Slots such as 31 and 33 may be made in back-pack frame members 3 and 4 and in adaptors 23 and 24 to provide means for inserting securing pins for the connection of the adaptors 23 and 24 to the back-pack frame. Members 21 and 22 have extra adjustment holes.

Figure 5:
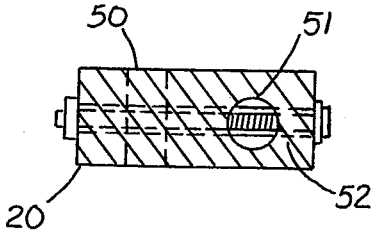
FIG. 5 is an increased scale cross-sectional view through the coupling of FIG. 3 taken along lines 5—5.

Coupling 20 is the means for interface between support frame 14 and right angle members 21 and 22. As shown in FIG. 5, coupling 20 has vertical slots such as slot 50 to receive vertical support rods 25 and 26.

Support rods 25 and 26 may have normally open spring loaded catches to permit the vertical securing of the rods to the coupling 20. Of course there are many other ways of securing the rods to the coupling including the use of slots and screws similar to those used to secure back-pack frame adaptors 23 and 24 to back-pack frame members 3 and 4. The horizontal slot 51 in coupling 20 provides a means for receiving right angle members 21 and 22 and permits a degree of adjustability by which the right angle members 21 and 22 can be pushed further apart or closer together to adapt to the structural characteristics of most back-pack frames. The elongated slot perpendicular to slot 51, such as slot 52, provides a means for securing the right angle members 21 and 22 to the coupling 20 via holes such as hole 30 in right angle member 22.

Thus the coupling 20 provides the dual function of coupling the upper and lower portions of the sun-shield structure and providing the means for adjustment of the width of the structure for compatibility with a variety of back-pack frames.

Although not shown in the figures, mosquito netting and transparent plastic coverings are readily attached to canopy 6 with either button snaps or the Velcro strips of the type discussed previously, or by any other suitable means. The addition of these lightweight coverings provides protection of the back-packer from insects and rain without adding any significant weight to the back-packer's burden.

The coupling 20 also permits easy attachment or detachment of the canopy 6, making it possible to quickly and conveniently deploy or stow the canopy depending upon the time of day and weather conditions. With or without canopy 6 detached and stowed, the remaining structure of this invention, including right angle members 21 and 22, coupling 20 and adaptors 23 and 24, provides and serves as a back-pack frame extender useful for attaching additional equipment to the back-pack frame if desired.

While various changes may be made in details of construction, it shall be understood that such changes shall be within the scope and spirit of the present invention as defined by the appended claims.

I claim:

1. A sun-shield assembly adapted for shielding a back-packer from sunlight and adapted for connection to each of a plurality of back-pack frames of non-uniform structure, the combination comprising:

a. a canopy having an opaque member of substantially fixed dimensions and adapted to be suspended in spaced relation above and forward of a back-packer's head; said canopy assembly also having a rod-like frame having a rectangular portion along substantially the entire perimeter of said opaque member and support-rods extending from said rectangular portion in a direction substantially perpendicular to said opaque member at locations adapted to be on the rear-most horizontal edge of said opaque member;

b. adaptor means for connecting said sun-shield assembly to any one of said plurality of back-pack frames;

c. extender means providing a pair of angle members, each such member having first and second portions substantially perpendicular to each other, the first portion of each such angle member being connected to said adaptor means for extending the height of said back-pack frames; and d. coupling means providing vertically extending slots slideably receiving said support-rods and also providing horizontally extending slots, the longitudinal axes of which are parallel to said rear edge of said opaque member, slideably receiving the second portions of said angle members, thereby coupling said support-rods of said canopy assembly frame to said extender means, whereby the distance between said second portions of said respective angle members may be varied while the distance between the support rods remains fixed.

2. A sun-shield assembly as defined in claim 1, wherein said canopy further comprises:

a plurality of contiguous foldable flap members, each vertically suspended from an edge of said opaque member and each being connected to contiguous flap members by means of detachable tabs whereby each said flap member is independently foldable on to the top surface of said opaque member; and means for securing said flap members to said top surface.

* * * * *